US007811975B2

(12) United States Patent
Erdemir et al.

(10) Patent No.: US 7,811,975 B2
(45) Date of Patent: Oct. 12, 2010

(54) METALWORKING AND MACHINING FLUIDS

(76) Inventors: Ali Erdemir, 2227 Stowe Cir., Naperville, IL (US) 60564; Frank Sykora, 20030 Horseshoe Hill Road, Caledon, ON (CA) L0N1C0; Mark Dorbeck, 4204 Pleasant Valley Rd., Brighton, MI (US) 48114

( * ) Notice: Subject to any disclaimer, the term of this patent is extended or adjusted under 35 U.S.C. 154(b) by 601 days.

(21) Appl. No.: 10/532,556

(22) PCT Filed: Oct. 24, 2003

(86) PCT No.: PCT/US03/33728

§ 371 (c)(1),
(2), (4) Date: Oct. 28, 2005

(87) PCT Pub. No.: WO2004/037959

PCT Pub. Date: May 6, 2004

(65) Prior Publication Data

US 2006/0122072 A1 Jun. 8, 2006

Related U.S. Application Data

(60) Provisional application No. 60/421,181, filed on Oct. 25, 2002.

(51) Int. Cl.
*C10M 125/26* (2006.01)
*C10M 105/12* (2006.01)
*C10M 105/14* (2006.01)

(52) U.S. Cl. ..... 508/156; 508/110; 977/773

(58) Field of Classification Search ..... 508/156, 508/110; 977/773
See application file for complete search history.

(56) References Cited

U.S. PATENT DOCUMENTS

| | | | | | |
|---|---|---|---|---|---|
| 2,999,064 | A | | 9/1961 | Sluhan | |
| 3,629,112 | A | | 12/1971 | Gower et al. | |
| 3,719,598 | A | | 3/1973 | King | |
| 3,974,674 | A | * | 8/1976 | Orozco et al. | 72/42 |
| 4,039,337 | A | * | 8/1977 | Brown et al. | 106/38.28 |
| 4,209,414 | A | | 6/1980 | Holgado et al. | |
| 4,262,057 | A | * | 4/1981 | Godek et al. | 428/470 |
| 4,330,419 | A | * | 5/1982 | Hall et al. | 507/266 |
| 4,448,701 | A | * | 5/1984 | Duerksen et al. | 508/160 |
| 5,209,860 | A | * | 5/1993 | Trivett | 508/170 |
| 5,468,401 | A | * | 11/1995 | Lum et al. | 508/115 |
| 5,507,962 | A | | 4/1996 | Jahanmir et al. | |
| 5,512,191 | A | * | 4/1996 | Krueger | 508/250 |
| 5,547,595 | A | * | 8/1996 | Hacias | 508/156 |
| 5,584,945 | A | | 12/1996 | Nittel et al. | |
| 6,025,306 | A | * | 2/2000 | Erdemir | 508/125 |

FOREIGN PATENT DOCUMENTS

SU 1810383 A1 * 4/1993

* cited by examiner

*Primary Examiner*—Glenn Caldarola
*Assistant Examiner*—Jim Goloboy
(74) *Attorney, Agent, or Firm*—Brooks Kushman P.C.

(57) ABSTRACT

Improved boron-based metal working and machining fluids. Boric acid and boron-based additives that, when mixed with certain carrier fluids, such as water, cellulose and/or cellulose derivatives, polyhydric alcohol, polyalkylene glycol, polyvinyl alcohol, starch, dextrin, in solid and/or solvated forms result in improved metalworking and machining of metallic work pieces. Fluids manufactured with boric acid or boron-based additives effectively reduce friction, prevent galling and severe wear problems on cutting and forming tools.

11 Claims, 8 Drawing Sheets

METALWORKING AND MACHINING FLUIDS

CROSS-REFERENCE TO RELATED PATENT APPLICATIONS

The present application is a national stage application of PCT Application No. PCT/US2003/033728, filed Oct. 24, 2003, which claims priority to U.S. Provisional Patent Application No. 60/421,181, filed Oct. 25, 2002.

This invention was made with government support under Contract No. W-31-109-ENG-38 awarded to the Department of Energy. The Government has certain rights in this invention.

FIELD OF THE INVENTION

The present invention relates generally to metalworking and machining fluids. More particularly, the present invention relates to metalworking and machining lubricants containing boric acid derivatives and or additives in a solid, liquid, and aerosol spray or gaseous form with carrier fluids (comprising substances such as water, cellulose derivatives, polyhydric and n-alcohols, polyalkylene glycol, etc).

BACKGROUND OF THE INVENTION

Machining or metalworking fluids are in widespread, high volume use throughout the manufacturing industry for their coolant, lubricant, and corrosion resistant properties during operations such as metal cutting, grinding, boring, drilling, and turning. These fluids are made of complex mixtures of oils, detergents, surfactants, biocides, lubricants, anti-corrosion agents, and other potentially toxic ingredients. While these fluids are essential for metal forming and machining, they are currently being examined with increased scrutiny because of hazards associated with worker exposure, including but not limited to skin rashes, increased cancer rates, respiratory problems and other issues. In fact, there is substantial scientific literature documenting that worker exposure to machining fluids is strongly associated with skin problems, and malignant respiratory effects such as occupational asthma. These fluids also pose substantial environmental problems associated with their disposal. There is now universal agreement on the need for safer more environmentally friendly metalworking fluids.

Various patents disclose additives formulated as lubricating agents into metal-forming and/or machining fluids. Boric acid, alkali borates, and borate esters are conventionally known for their beneficial effects when included in lubricating oil formulations. Polyhydric alcohol and polyalkylene glycol have also been used or added in oils to enhance their properties. The use of alkyl carboxylates, such as the ester glycerol monooleate, have also found uses as beneficial additives or as components in lubricating oil compositions.

Borated lubrication compounds are known lubrication additives for oil and fuel compositions. Borated lubrication compounds are known to have high viscosity indices and favorable low temperature characteristics. Such boron-containing compounds are known to be non-corrosive and to possess antioxidant, fire retarding and potential antifatigue characteristics. Such compounds may also exhibit antiwear and high temperature dropping point properties for greases. Borated esters and hydrocarbonyl vicinal diols have previously been proposed as lubricant additives, especially as mixtures of long chain alcohols or hydroxyl-containing aliphatic, preferably alkyl, carboxylates. Borated lubrication compounds are generally obtained by synthetic methods known in the art. Typically, these borated lubrication compounds are prepared by reacting boric acid or boric oxide with appropriate aliphatic or alkoxylated compounds.

Borated derivatives of phosphorus are also known additives for lubricant compositions. Such borated phosphorus derivatives include borated dihydrocarbonyl phosphonates. Borated phosphite additives may be synthesized by reacting dihydrocarbonyl phosphites with such boron-containing compounds as boric oxide, metaborates, alkylborates or boric acid in the presence of a hydrocarbonyl vicinal diol.

Organometallic boron-containing compounds are yet another class of additives. These compounds contain a metal capable of forming a complex with an organic compound. Useful metals for use in such compounds include Na, K, Mg, Ca, Sr, Ba, Ti, Zr, V, Cr, Ni, Mn, Fe, Co, Cu, Zn, B, Pb, and Sb. Borated versions of such organometallic complexes are derived or synthesized from both aliphatic and heterocyclic organic compounds.

Although various references describe boron-containing additives that provide lubricity to metal-forming or cutting lubricant compositions, conventionally known additives are based on compositions that require complex formulations and lengthy preparation and therefore are not cost effective as lubricants. Also, large amounts of boron additives are needed in order to achieve sufficient lubricity. Some of the lubricant compositions contain organic and/or petroleum based products that are flammable and difficult to clean and/or dispose after the metal-forming or machining operations. Their incorporation into carrier fluids would likely require complex processing steps and hence be prohibitively expensive. A need therefore remains for a readily available product that is cost effective, easy to apply, use and/or dispose.

SUMMARY OF THE INVENTION

It is therefore an object of the present invention to develop an improved metalworking and a machining fluid that is environmentally friendly.

It is another object of the invention to provide an improved metalworking and machining fluid wherein the active ingredient comprises a naturally occurring mineral.

It is still another object of the present invention to provide an improved metalworking and machining fluid that is relatively easy to apply.

It is yet another object of the present invention to provide an improved metalworking and machining fluid that is used in very small quantities relative to conventional fluids.

It is still another object of the present invention to provide an improved metalworking and machining fluid that has minimal negative health implications for workers relative to conventional fluids.

It is a further object of the present invention to provide an improved metalworking and machining fluid that possesses superior performance qualities relative to conventional fluids.

It is still another object of the present invention to provide an improved metalworking and machining fluid that washes off a user's hands easily relative to conventional fluids.

It is yet another object of the present invention to provide an improved metalworking and machining fluid such that residual amounts will not hamper additional processes such as welding, coating and/or painting.

It is yet another object of the present invention to provide an improved metalworking fluid that is based on water and/or alcohol solutions and that can be sprayed on the surfaces of tools and work-pieces as a spray coating application before the metalworking operation is performed.

It is another object of the present invention to provide an improved metalworking and machining fluid wherein after the metal forming or machining process, the residual materials may be disposed of with minimal harmful effects to the environment.

In accordance with the above objects, the present invention comprises improved boron-based metal working and machining fluids that are environmentally friendly, easy to make, and provide significant performance improvements in both metal forming and machining applications. The present invention teaches novel uses of boric acid and boron-based additives that, when mixed with certain carrier fluids, such as water, cellulose and/or cellulose derivatives, n-alcohol, polyhydric alcohol, polyalkylene glycol, polyvinyl alcohol, starch, dextrin, in solid and/or solvated forms generally result in improved metalworking and machining of metallic work pieces.

Boron and/or boric acid derivatives dissolved or dispersed in an n-alcohol solution can also produce a uniformly thick and strongly bonded coating on applied surfaces. They can be brushed or sprayed on the surfaces of metallic work pieces. Alternatively, metallic work pieces can be dipped into n-alcohol solution containing boric acid and/or boron derivatives. The films that form on the surfaces protect them against wear and provide easy shear or superior lubrication.

Fluids manufactured according to the present invention effectively reduce friction, prevent galling and severe wear problems on cutting and forming tools. Such fluids may also effectively dissipate heat and hence keep the cutting edges of tools, cool and sharp. The increase in lubricity that occurs upon addition of the boric acid or boron-based compounds of the invention results in lower wear in forming dies, minimal transfer of metal to die surfaces and substantially enhanced cutting tool and die life. The surface of cut or of formed work pieces becomes very smooth, which may eliminate secondary grinding and/or polishing. The new formulations based on the uses of boric acid and/or boron-based additives provide a cleaner environment, at a lower cost relative to other additive technologies currently in use for metal cutting and/or forming operations.

BRIEF DESCRIPTION OF THE DRAWINGS

FIG. 9(*b*) is a microscopic image of the disk material showing severe wear damage after the friction test of FIG. 8;

DETAILED DESCRIPTION OF THE PREFERRED EMBODIMENTS

Figure 1:
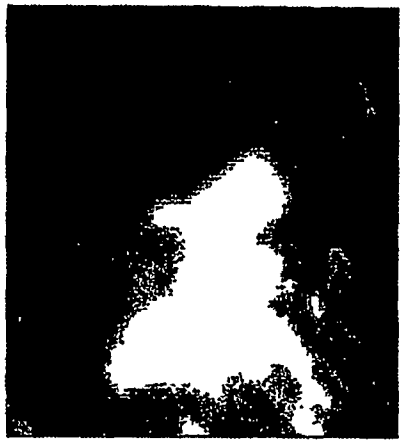
FIG. 1 is a thermal image of a tool insert and stainless steel workpiece lubricated by a "Coolube 2210" commercial fluid.

The present invention provides a method for achieving improved lubricity in metalworking and machining fluids. The present invention utilizes a family of simple, inexpensive, and environmentally-benign boron compounds which, when added to a metalworking and machining fluids, improve the lubricating properties of the fluids, prolong wear life of dies and tools, reduce or eliminate environmental toxicity, improve surface finish of work pieces, and save energy by reducing friction between forming or cutting surfaces.

The present invention teaches the use of a new series of boron-based formulations suitable for lubrication and cooling in many metal forming and machining applications. The new series of boron-based additives enables forming, cutting, and/or machining of metals and alloys (including secondarily coated metals and alloys, such as galvanized steel, magnesium and its alloys, titanium and its alloys and other alloys) without causing environmental pollution. The new boron-based additives comprise blends of boron and/or boric acid derivatives in solid or liquid form with carrier fluids such water, cellulose, polyhydric alcohol, n-alcohol, polyalkylene glycol, etc., that are environmentally benign and safe to handle. They can be applied to surfaces by brushing, dipping, spraying or pouring in super-cooled, warm or hot forms. There are a number of different potential formulations that can be prepared in accordance with the present invention, depending on the application, but all are systems based on some form of boron/boric acid material in combination with one or more cellulose derivatives, polyhydric alcohol, polyalkylene glycol, and/or other water soluble/environmentally friendly materials.

While tests have demonstrated that these materials are non-flammable, non-toxic, easy to use and recover, the materials also provide significant performance improvements in both metal forming and machining applications. These improvements include reduced die wear in metal forming, cooler tools, longer tool life and smoother surface finishes in machined products. These new formulations also provide an improved cost-benefit relationship against fluids in current use. The new machining and metal working fluids according to the present invention offer not only the important desired worker and environmental benefits, but also provide improved performance and lower manufacturing costs, even before the high disposal costs that are incurred with the current fluids are considered, given that disposal costs often exceed the initial cost of the fluid. Tests have shown that the new fluids improve metal formability, cutting performance of tools, and provide smoother surface finishes on cut or formed metal products. The machining fluids according to the present invention are non-flammable, non-toxic, easy to use, recover, and recycle for further use.

Fluids developed according to the present invention comprise boron and/or boric acid derivatives as active lubricating agents. The active lubricating agents can be blended into carrier fluids at concentrations up to 60%. For optimum performance, however, less than 15% is needed for metal-forming purposes. Spray forms or formulations in alcohol or water solutions can be diluted to concentrations as low as 1%. For metal-cutting or machining, concentrations can be as high as 50% to exhibit improved performance. In addition to lubrication, the active boron and boric acid derivatives in carrier fluids prevent corrosion and transfer of materials to die surfaces during metal-forming, while also promoting uniform elongation and stretching of the work-pieces in cold forming processes and providing the user with the ability to achieve more radical angles.

Cellulose and/or cellulose derivatives used in the formulations are fully compatible with boric acid, primarily due to the action of hydrogen bonding. Process benefits are derived from the reaction of alkali cellulose with polyhydric alcohol. One significant benefit is the oxidation characteristic due to heat evolved in the forming process. It has an ash content of only 0.2 max silica free and burns out over 250° C.

A physical property of the cellulose derivatives used in the formulations of the present invention is that the derivatives assist in the formation of a uniform film on the applied surfaces of work-pieces and help in producing hydrogen bonds with the active boron derivatives. The film that is formed on the surfaces of work-pieces and/or dies protects them against wear and provides easy shearing which is needed for lubrication during metal-forming. The film formed on the surfaces is water washable, has no tack, and provides a very low friction coefficient. If a liquid form of the derivatives is used, it works as a water soluble suspension agent, emulsion stabilizer and binder. Additionally, the derivative forms a glaze and an oil and oxygen barrier that prevents the boron from easily coming off a coated metal surface. These properties make the derivatives suitable for application as a thin lubricant film on metal coils or sheets. Coated coils or sheets can be stored safely and used at a later time for metal-forming purposes. The cellulose derivatives used in the formulations have some lubricating properties, but the best lubricity is achieved when the derivative is mixed with boron and/or boric acid derivatives in a carrier fluid. The preferred concentration of cellulose in lubricant formulations varies between about 0.5% and about 10%. Importantly, the additives may be easily and inexpensively obtained, and are mixed directly with carrier fluids without the necessity for any intervening or expensive chemical synthesis. Other ingredients which may possess an unacceptable level of toxicity are also not used.

The method includes adding a boron compound, primarily based on boron, oxygen and hydrogen, or boric acid to a carrier fluid to provide a boron-containing lubricant suitable for machining and metal-forming operations. The additives of the present invention can be any simple boron compound that dissolves in carrier fluids selected from the group of water, cellulose derivatives, polyhydric alcohol, n-alcohol, and polyalkylene glycol to form a solution, preferably fully miscible with the fluid, to produce a concentrate. Suitable boron compounds for use in the methods for providing lubricity in carrier fluids include, but are not limited to, boric acid, borax, boron oxide, boric acid powders, tri-methyl boron, tri-methoxy-boroxin, boron derivates that generate boric acid during the hydrolysis process, or combinations of these. In the end, the carrier fluids may have a boron compound or boric acid concentration ranging from about 0.5% to about 20.0%, while the balance consists of the carrier fluid. Suitable carrier fluids for use with the present methods for providing lubricity in a formulated metalworking and machining fluid include water, cellulose derivatives, polyhydric alcohol, n-alcohol, polyalkylene glycol, polypropylene glycols, polyester derivates, and carbomer but are not limited to these or combinations thereof.

Suitable lubricants for use with the present methods for providing lubricity in a carrier fluid may also include lubricating oil products such as vegetable oils, mineral oils, synthetic lubricants and greases. These may also be used in metalworking or machining applications.

In certain embodiments of the invention, the boron-based or boric acid additives are added to a carrier with very high ability to completely dissolve these additives prior to adding such concentrates into the fluids or final products. In such embodiments, the fluid may be a glycol solution and/or water. In one embodiment of the invention, a concentrated solution of boric acid is prepared with cellulose and/or cellulose derivates, and then mixed with the water to provide lubrication in metal forming operations. Such a lubricant forms a dry film and can dramatically reduce friction and minimize wear of sliding surfaces when tested in a standard wear test machine under standard test conditions as described by ASTM.

In another embodiment of the invention, hydroxypropane is used as the primary carrier of the boron derivate and is used because of its high boiling point (more than 150° C.), water solubility, the ability to modify its boiling point, its low toxicity and bactericidal properties. Hydroxypropane also promotes hydrogen bonding with the boron derivate, has excellent lubricating properties and is an hygroscopic liquid helping with the water formulation. Preferably 1,2 dihydroxypropane is used, and the minimum content according to one embodiment of the invention is 15%.

A mixture comprising polyoxyalkylene glycol also works as a thickening agent, providing the desired viscosity to help carry away metal chips. The mixture has film forming properties at high temperatures that produce controlled cooling rates and promote the adhesion of the boron derivate to the tool surface. The mixture possesses shear stability, is non-corrosive, non-foaming, does not sludge or gum, and is thermally and chemically stable. The mixture is also not affected by hydrolysis and prevents bacterial growth and oxidation, resulting in a decrease in tool wear. Because there is less evaporation and no growth of bacteria or fungi, the fluid also experience an increase in its useful life.

Figure 2:
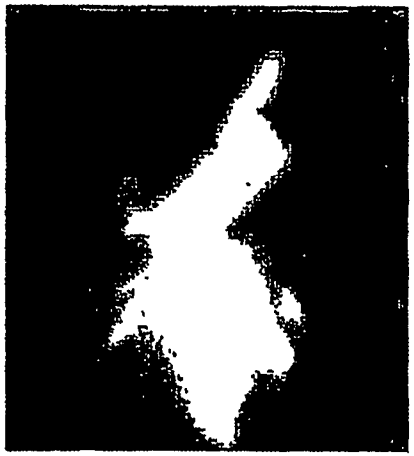
FIG. 2 is a thermal image of a tool insert and stainless steel workpiece lubricated by a "Chevron Britecut" commercial fluid.
Figure 3:
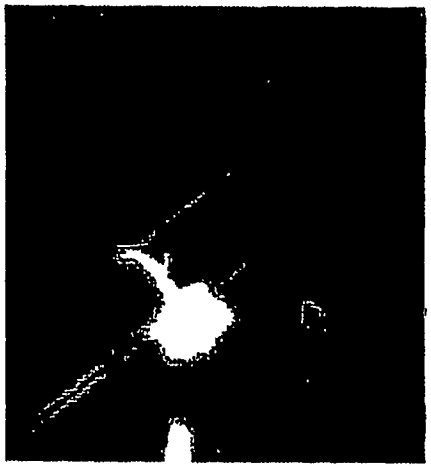
FIG. 3 is a thermal image of a tool insert and stainless steel workpiece lubricated by a "Exxon Cutwell" commercial fluid.
Figure 4:
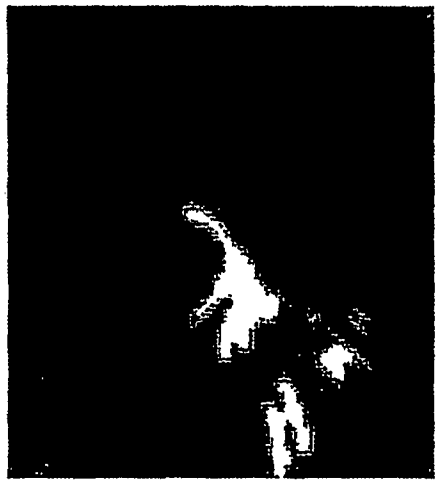
FIG. 4 is a thermal image of a tool insert and stainless steel workpiece lubricated by a "Shark-300" boric acid based fluid according to the present invention.
Figure 6:
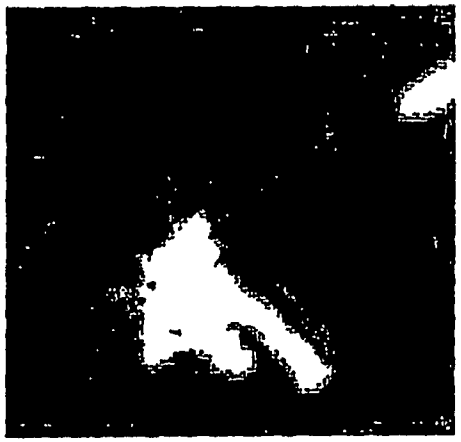
FIG. 6 is a thermal image of a tool insert and aluminum alloy (6061) work piece lubricated by an "Coolube 2210" conventional commercial fluid.
Figure 7:
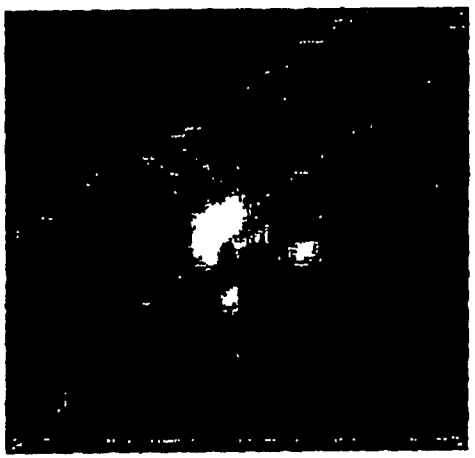
FIG. 7 is a thermal image of a tool insert and aluminum alloy (6061) work piece lubricated by boric acid based fluid in accordance with the principles of the present invention.
Figure 5:
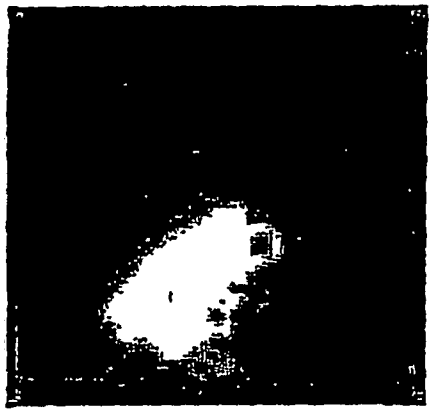
FIG. 5 is a thermal image of a tool insert and aluminum alloy (6061) work piece lubricated by an "Exxon Cutwell" conventional commercial fluid.

Observations of the actual use of boric acid based cutting fluid in lathe and milling applications have been compared to high quality synthetic and water dilutable cutting fluids. In one application, a one-quarter inch keyway was cut lengthwise into a high alloy steel shaft that is twenty feet long. With the use of a conventional, dilutable cutting fluid, three end-mill tool bits are typically required to make a single cut. It is not unusual for two of the three bits to break during the process. Significant noise also occurs from tool chatter, and unpleasant fumes are also generated in this process. The finished keyway shows tooling marks, indicating a rough cut. When boric acid based fluid according to the present invention is used, on the other hand, there is a distinct absence of tool chatter, lack of fumes and the finished surface appears to have been polished, with one pass of the tool. Only one tool bit was required to make a comparable cut, and the bit remained sharp and relatively cool to the touch even as the operation was in progress. Thermal images of this process using conventional fluids are shown in FIGS. 1-3. FIG. 1 is an image of this process when the commercial fluid Coolube 2210 is used; FIG. 2 shows the same process using Chevron Britecut; and FIG. 3 shows this process using Exxon Cutwell. FIG. 4 shows a comparable cut using a boric acid based fluid entitled Shark-300 in accordance with the principles of the present invention. Similarly, FIGS. 5 and 6 are thermal images of WC tool inserts and aluminum (6061) work pieces lubricated by Exxon Cutwell (FIG. 5) and Coolube 2210 (FIG. 6) commercial fluids. FIG. 7, on the other hand shows a thermal image of a substantially identical tool insert and work piece lubricated by a boric acid based fluid.

After a significant number of cutting tests, it was found that tool bit life is extended as much as three times what is normally expected when used according to the principals of the present invention. In these tests, a 1" diameter "316" stainless steel shaft and a 1⅜" "6061" aluminum shaft were cut on a lathe that ran at 620 rpm. The carbide tool bit feed rate was 2 inches per minute and depth of cut was 3/32" in all cases. During these tests, it was observed that that "chuck drag" (resistance to rotation) was reduced substantially or eliminated when used in accordance with the principles of the present invention. Chip quality and chip removal was also much improved, as heat was more efficiently removed from the work-piece during the machining process.

Furthermore, the work-piece machined according to the present invention retained a normal color due to the cool operating temperature. High heat typically causes a blue tone or some other off-color, which is generally not desirable during manufacturing. Such coloration was seen on surfaces that were cut with some of the commercial fluids tested in our trials. However, there was no discoloration or damage to the cut surfaces because of the low heat generated by the use of boric acid based fluids.

Additionally, the tapping process (cutting a thread) in cast iron is very difficult due to the random granular structure of castings. Taps are broken very frequently during this difficult process, even with superior cutting fluids. Using boric acid based fluids changes the characteristic of cutting a thread significantly. In a number of tests, the ease of effort as the tap cut through the casting was significantly better than with typical cutting fluids. Tools remained sharp and were much less inclined to break. This is particularly important because breakage, when it occurs, introduces serious repair or scrap problems that translate into increased manufacturing costs.

A broad range of aluminums, mild steel, steel alloys, stainless steel, galvanized steel, brass, bronze, magnesium and its alloys, titanium and its alloys and other materials respond similarly to the application of boric acid based fluids during the machining process. Cutting quality is improved to the extent that subsequent honing, grinding or polishing operations can be minimized. Using "Near Dry Lubrication Techniques", less atomization of the fluid occurs with the cooler temperatures. There is therefore a reduced possibility that ingestion and/or inhalation will occur over time, along with a lesser possibility of occupational health issues.

Smaller quantities of boric acid based fluid according to the principles of the present invention serve to accomplish the same task that may take two or three times more of the traditional cutting fluids. Minimal volumes of boric acid based fluid are required when compared to typical cutting fluids. This greatly reduces the need for capturing waste fluid. Additionally, the fluids according to the present invention may be reused for an extended period if recaptured or recycled without a deterioration in performance of the fluid. Due to the bactericidal nature of the fluid, there is little chemical maintenance required and the fluid is more stable with longer life, unlike most other cutting fluids.

Thermal imaging of tool inserts and the material being cut provide valuable information about the ability of cutting fluid to dissipate heat being generated during cutting action. One of the main functions of the fluids is to dissipate heat rapidly. Dissipating heat rapidly allows the tool insert to last longer by preserving its important mechanical properties and preventing any structural or chemical changes that lead to failure. It has been clearly observed that when boric acid containing fluids are used in metalcutting operations, the temperature of cutting edges as well as the cut pieces is substantially lower than what can be achieved by the conventional or commercial fluids.

In addition to the benefits described above, it is believed that a number of benefits result from the use of boric acid-containing fluids according to the present invention. These benefits include:

(1) Precise torque measurements. Lower torque can be achieved by the use of boric acid containing fluids. This translates into substantial energy savings.

(2) Surface finish or roughness measurements. Boric acid containing fluids provide improved surface finish that can minimize or eliminate additional polishing and/or machining steps.

(3) Monitoring of smoke or evaporative gases being released during machining. This is particularly important for industrial hygiene and worker safety.

(4) Assessment of surface cleanliness or ease of cleaning of machined or formed surfaces. Boric acid containing fluids only require washing or rinsing in running water.

(5) Assessment of chip formation characteristics of each fluid. Continuous and smooth chip formation is highly desirable, and boric acid containing fluids may provide this benefit as well.

A concentrated solution of boric acid according to the present invention is prepared with cellulose and/or cellulose derivates, and then mixed with the water to provide lubrication in metal forming operations. An alternative version of the lubricating composition includes water or alcohol solutions of boric acid and boron-based compounds. Such a lubricant forms a dry film and can dramatically reduce friction and minimize wear of sliding surfaces when tested in a standard wear test machine under standard test conditions as described by ASTM. Compared to a conventional fluid used in aluminum forming, the formulation according to the present invention provides excellent lubrication and prevents wear on sliding surfaces. Compared to uncoated galvanized steel surfaces, the formulations according to the present invention provide excellent lubrication and prevents wear of sliding surfaces.

Friction and wear evaluation of the dry film lubricants containing boric acid based additives were performed using a pin-on-disk test machine whose detailed description can be found in the 1990 Annual Book of ASTM Standards, Volume 3.02, pages 391-395, which is incorporated herein by reference. In particular, the machine comprises a stationary top-mounted pin that rubs against a unidirectional rotating disk or flat. The pins can be either flat pins or hemispherically tipped pins. One such type of hemispherically tipped pin includes a 5" radius ground onto one of the faces. Alternatively, ⅜" or ½" diameter balls may also be used. Disks up to approximately 3" in diameter and approximately ¼" thick may be tested on the machine. The chuck that holds the discs can also hold flats of dimensions up to 2"×2". The lubricants are usually applied to the disk surface, and the pins are rubbed against the disk. The load is applied to the pin by using dead weights. During one set of tests that were performed, 10 to 20 Newton loads were used, and the sliding velocity of the rotating disk was adjusted to give linear velocities of 0.01 m/s over 5 km. Tests were run at room temperature and in open air whose relative humidity varied between 30 and 60%.

Figure 8:
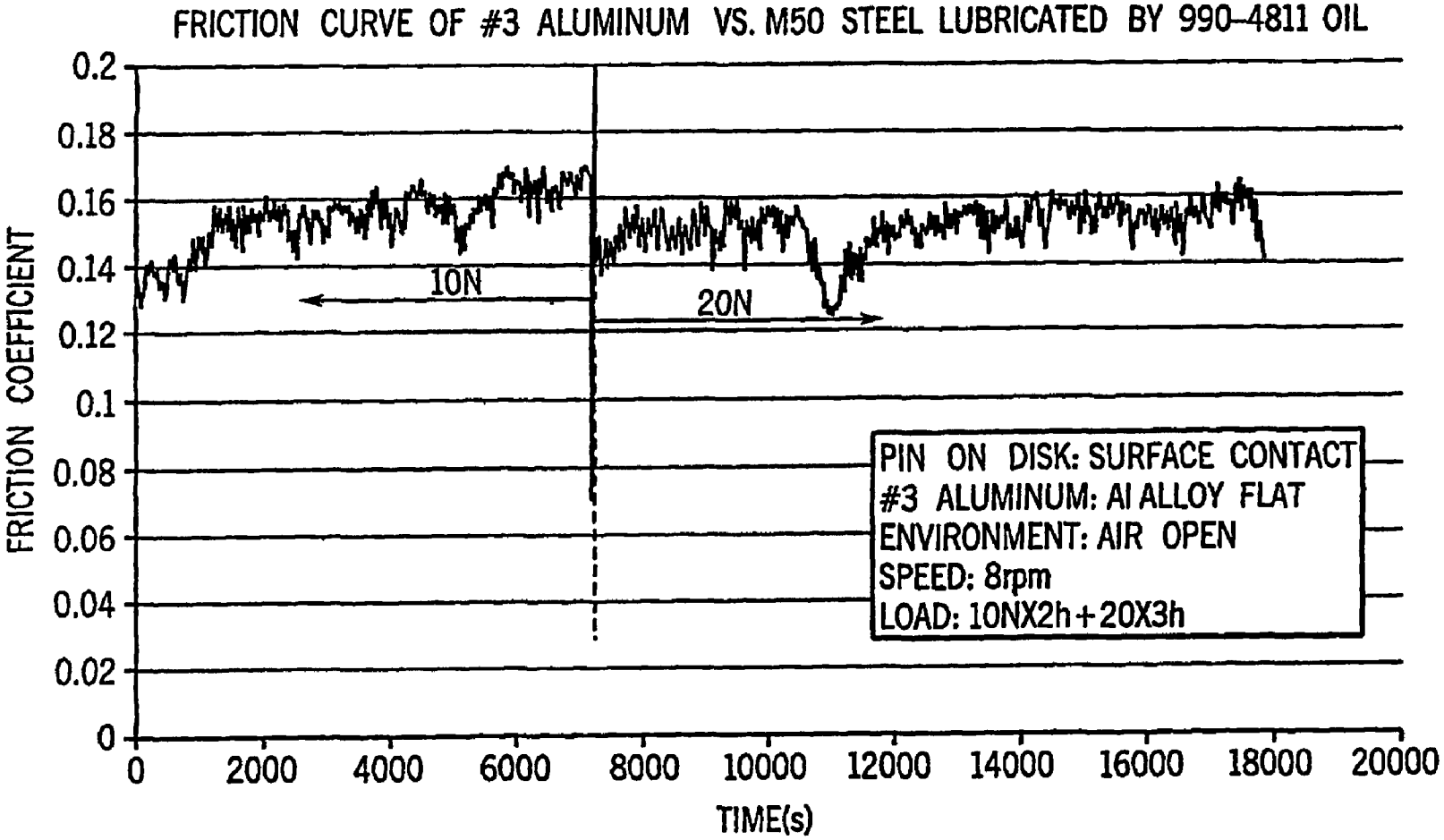
FIG. 8 is a plot showing the frictional performance of a conventional commercial metal forming fluid commonly used in aluminum pan making.
Figure 9A:
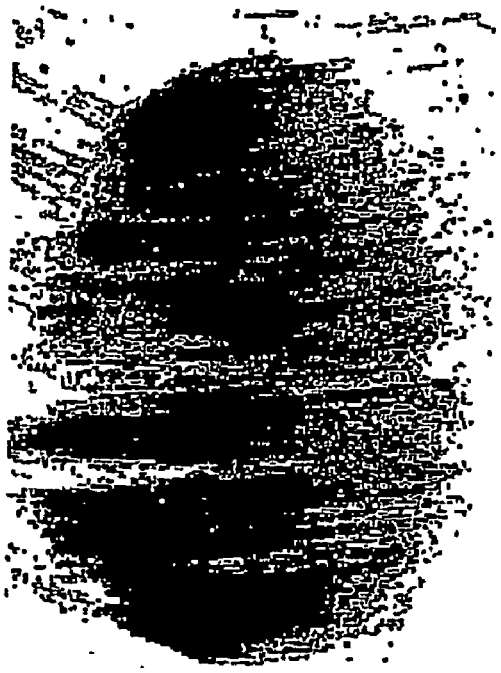
FIG. 9(*a*) is a microscopic image of the pin used during the sliding test of FIG. 8.
Figure 9B:
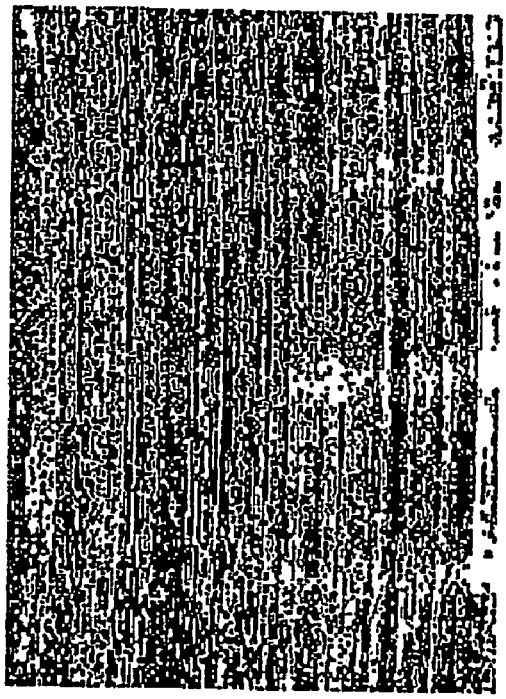
Figure 10:
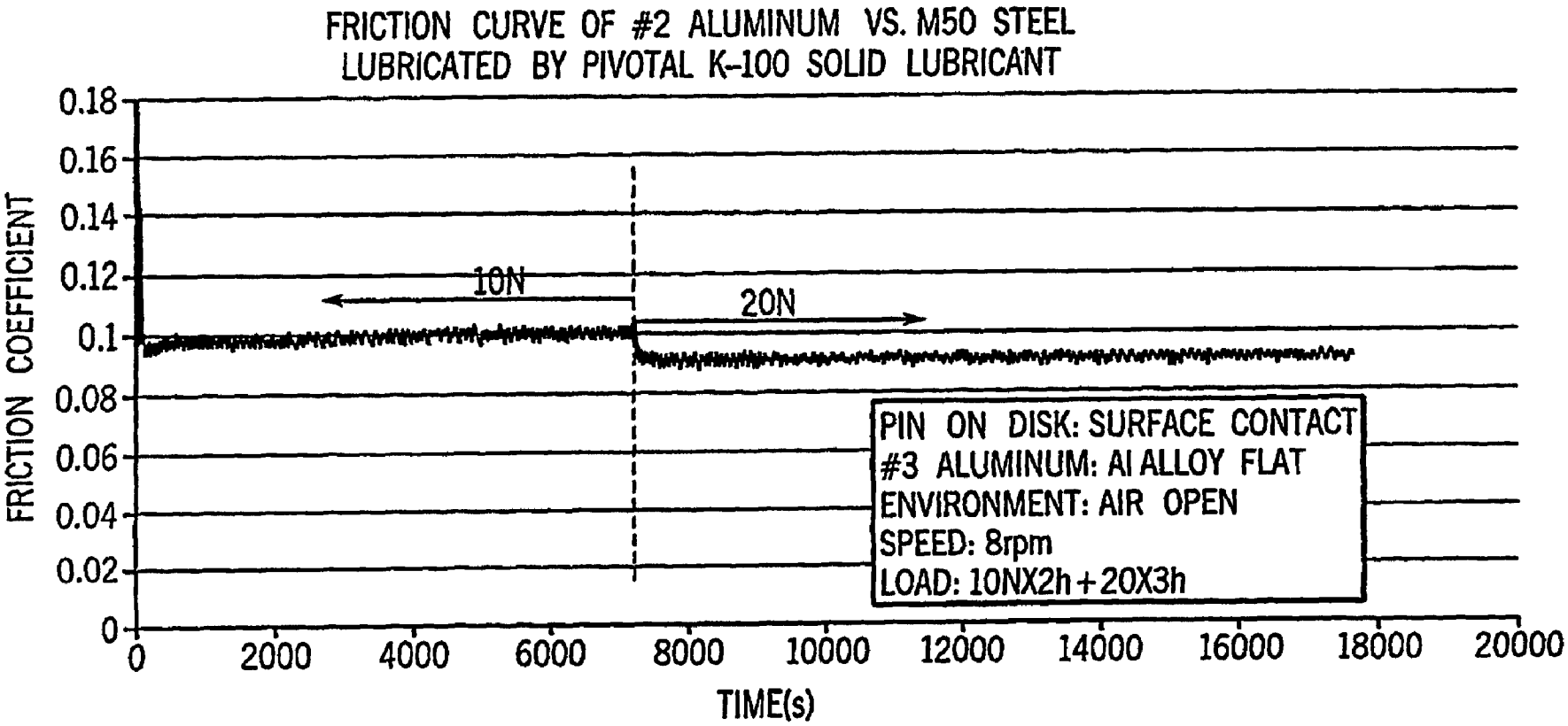
FIG. 10 is a plot showing the lubrication performance of a boric acid based metalforming fluid used in substantially identical conditions as the test which is described in FIG. 5.
Figure 11:
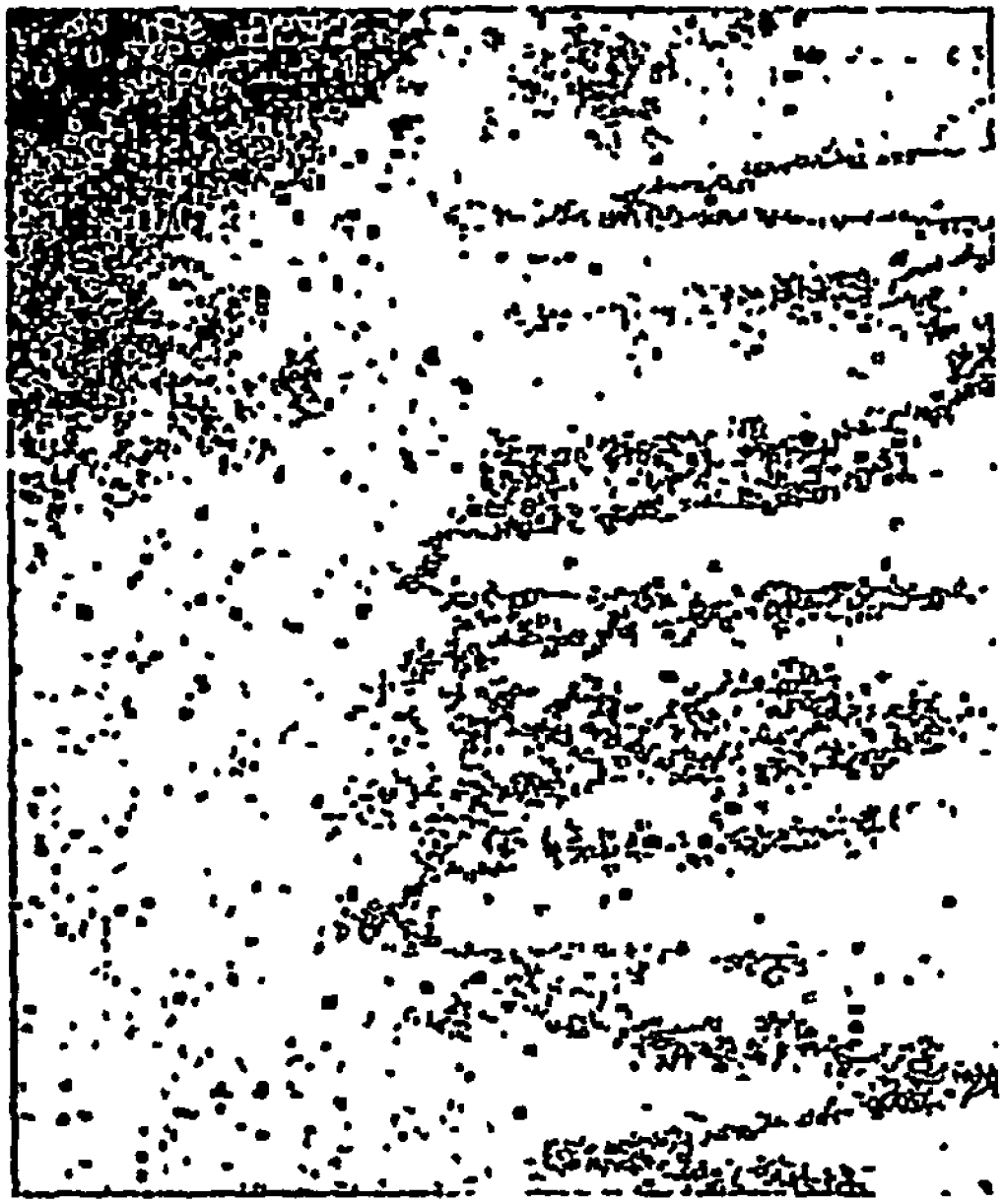
FIG. 11 is a microscopic image of the pin surface showing no wear damage after the test described in FIG. 10.

FIG. 8 shows the frictional performance of a commercial metal forming fluid commonly used in aluminum pan making. FIGS. 9(*a*) and 9(*b*) show microscopic images of the pin (FIG. 9(*a*)) and the disk material (FIG. 9(*b*)) showing severe wear damage after the friction test of FIG. 8. Conversely, FIG. 10 details the lubrication performance of a boric acid based metalforming fluid used in a substantially identical sliding test involving a steel pin and an aluminum alloy. FIG. 11 shows a microscopic image of the pin surface showing no wear damage after this test.

Figure 12A:
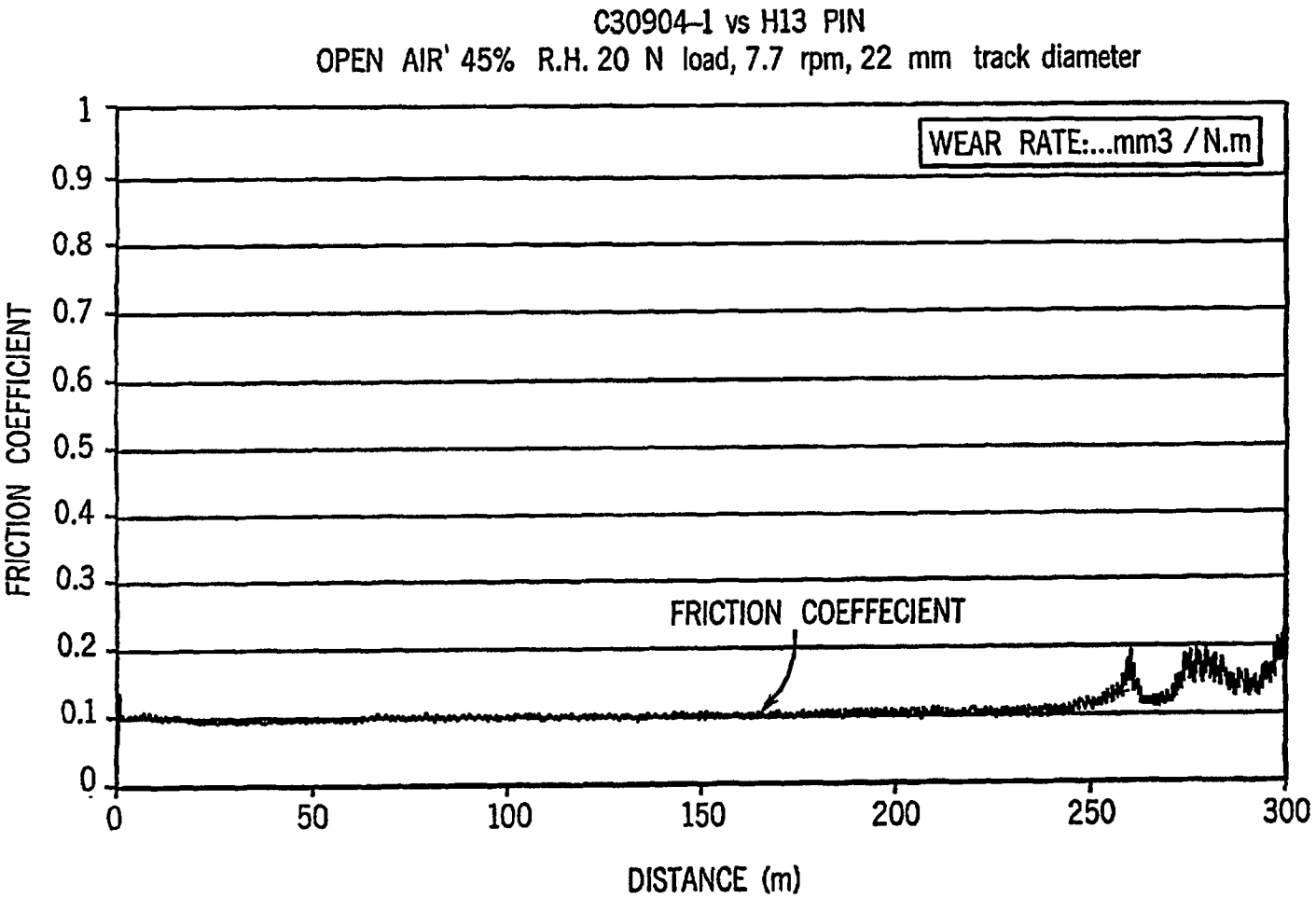
FIGS. 12(*a*) and 12(*b*) are plots comparing the lubrication performance of a boric acid based methanol solution sprayed on galvanized steel sheets vs galvanized steel alone during sliding against a steel pin.
Figure 12B:
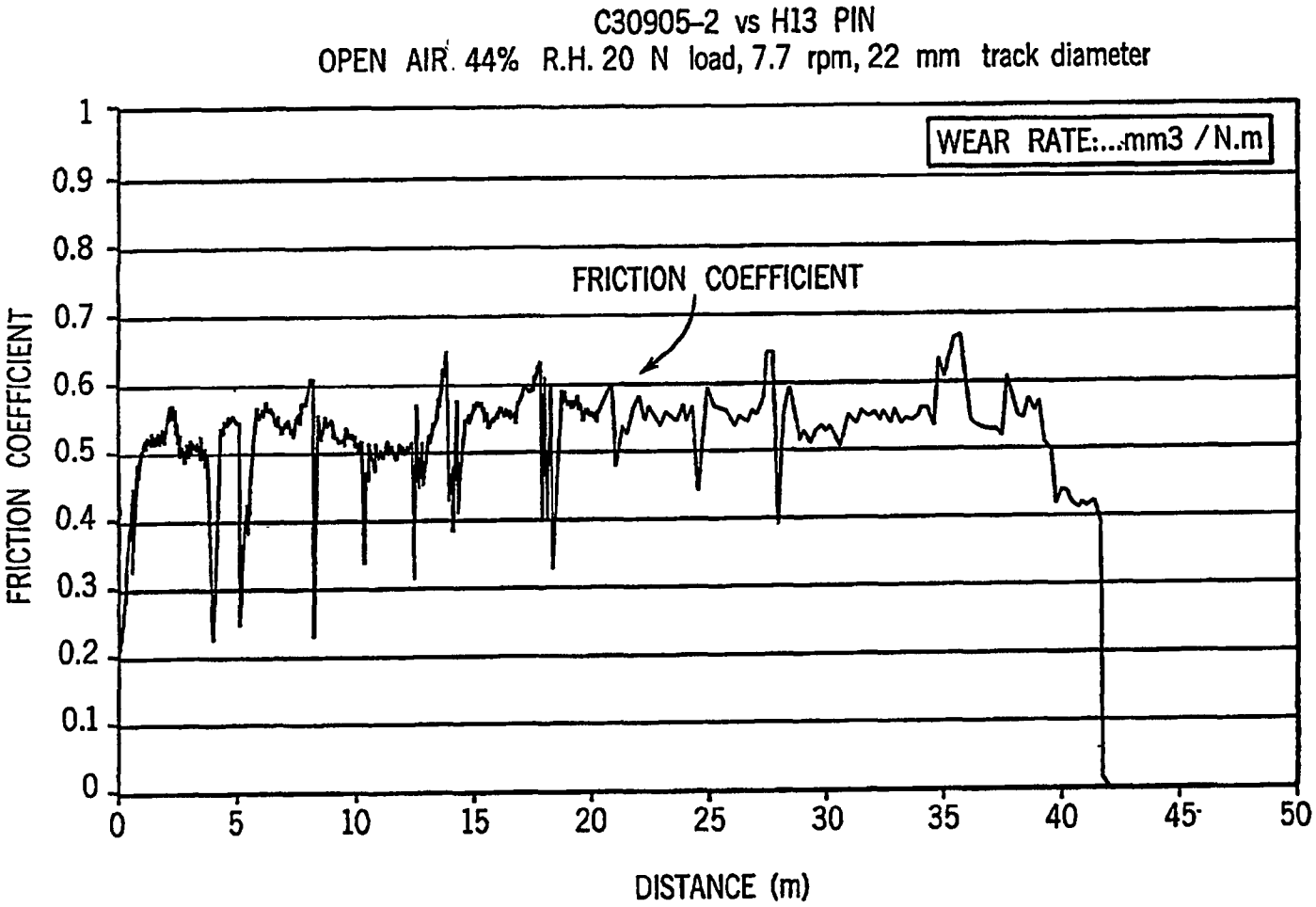

FIGS. 12(*a*) and 12(*b*) compare the frictional performance of a galvanized steel having a boric acid layer that was produced by spraying a methanol solution of boric acid, represented in FIG. 12(*a*), with that of a galvanized steel alone, represented in FIG. 12(*b*). The same lubricating layer can be built by spraying hot-water solutions of boric acid on all kinds of metallic surfaces including aluminum and steel or galvanized steel surfaces. Hot-water solutions are environmentally more benign and do not pose fire hazards. Microscopic image of the sliding steel pin surfaces show no wear damage after the test with boric acid lubricated surfaces.

It should be understood that the above description of the invention and specific examples and embodiments, while indicating the preferred embodiments of the present invention are given by demonstration and not limitation. Many changes and modifications within the scope of the present invention may therefore be made without departing from the spirit thereof and the present invention includes all such changes and modifications.

What is claimed is:

1. A method of providing lubricity in a forming or machining fluid, comprising the steps of:

providing a forming or machining fluid;

providing a boron compound;

dissolving said boric compound in a solvent selected from the group consisting of methanol, ethanol, isobutyl alcohol, pyridine, isoamyl alcohol, n-propanol, 2-methylbutanol, glycerol, lactate esters and combinations thereof;

mixing said boron compound and solvent in the forming or machining fluid at a concentration of from about 2% to about 24% of said solvent by weight;

wherein said boron compound is boric acid;

said boron compound is in the form of a nanometer-sized particulate and; the forming or machining fluid is selected from the group consisting of n-alcohols, polyalkylene-glycols, polyvinyl alcohol, glycerol, and combinations of any two or more thereof.

2. A method of providing lubricity in a forming or machining fluid, comprising the steps of:

providing a forming or machining fluid selected from the group consisting of polyalkyleneglycols, polyvinyl alcohol, glycerol, and combinations of any two or more thereof;

dissolving boric acid in a solvent selected from the group consisting of methanol, ethanol, isobutyl alcohol, pyridine, isoamyl alcohol, n-propanol, 2-methylbutanol, glycerol, lactate esters and combinations thereof; and mixing the solvent and dissolved boric acid in the forming or machining fluid at a concentration of from about 2% to about 24% by weight.

3. The method of claim 2, wherein the solvent is selected from the group consisting of methanol, ethanol, isobutyl alcohol, pyridine, isoamyl alcohol, n-propanol, 2-methylbutanol, glycerol, lactate esters and combinations thereof.

4. The method of claim 2 wherein the method further comprises spraying, roll-coating or dipping a metal substrate in the forming or machining fluid.

5. The method of claim 4 wherein the forming or machining fluid and the said boron compound and solvent are introduced simultaneously within an applicator for the purpose of metering the amount or concentration of the forming or machining fluid onto a substrate via a spray application.

6. The method of claim 2 wherein glycerol or a polyalkylene glycol is the forming or machining fluid.

7. The method of claim 2, further comprising drying the forming or machining fluid to a dry film to provide cooling and lubrication in metal parts stamping operations.

8. The method of claim 2 further comprising drying the forming or machining fluid to a dry film wherein the dry film is capable of being removed with a cold water rinse after a metal forming operation.

9. The method of claim 2, wherein the forming or machining fluid is a drilling mud.

10. The method of claim 2, wherein the forming or machining fluid is selected from the group consisting of polyalkyleneglycols, polyvinyl alcohol, and a combination thereof.

11. The method of claim 2, wherein the solvent is methanol.

* * * * *